US008312828B2

(12) United States Patent
Luo

(10) Patent No.: US 8,312,828 B2
(45) Date of Patent: Nov. 20, 2012

(54) PRELOADING TO REDUCE LOADS AND SAVE STEEL ON TOPSIDES AND GRILLAGE OF CATAMARAN SYSTEMS

(75) Inventor: Michael H. Y. Luo, Bellaire, TX (US)

(73) Assignee: Technip France, Courbevoie (FR)

( * ) Notice: Subject to any disclaimer, the term of this patent is extended or adjusted under 35 U.S.C. 154(b) by 467 days.

(21) Appl. No.: 12/393,617

(22) Filed: Feb. 26, 2009

(65) Prior Publication Data

US 2010/0186651 A1 Jul. 29, 2010

Related U.S. Application Data

(63) Continuation-in-part of application No. 12/359,860, filed on Jan. 26, 2009.

(51) Int. Cl.

| | |
|---|---|
| ***B63B 35/44*** | (2006.01) |
| ***B63B 39/00*** | (2006.01) |
| ***E02B 17/00*** | (2006.01) |
| ***E02B 17/08*** | (2006.01) |

(52) U.S. Cl. ..... 114/61.1; 114/121; 114/125; 405/203; 405/205; 405/209

(58) Field of Classification Search ..... 114/61.1, 114/121–125, 264, 265; 405/195.1, 203–209
See application file for complete search history.

(56) References Cited

U.S. PATENT DOCUMENTS

| | | | | | |
|---|---|---|---|---|---|
| 1,681,533 | A | * | 8/1928 | Giliasso | 175/8 |
| 2,581,098 | A | * | 1/1952 | Guenzel | 405/204 |
| 2,675,681 | A | * | 4/1954 | Dawson | 405/208 |
| 2,689,460 | A | | 9/1954 | Wilson | |
| 3,352,269 | A | * | 11/1967 | Dollison | 114/265 |
| 3,977,346 | A | | 8/1976 | Natvig et al. | |
| 4,135,842 | A | * | 1/1979 | Blight et al. | 405/209 |
| 4,714,382 | A | * | 12/1987 | Khachaturian | 405/204 |
| 4,744,697 | A | * | 5/1988 | Coppens | 405/204 |

(Continued)

FOREIGN PATENT DOCUMENTS

EP 0 911 255 4/1999

(Continued)

OTHER PUBLICATIONS

Greeves, J. and Huang, E., "Non-conventional deck lifts for deepwater Spars, TLPs: Managing loads and vessel dynamics", Offshore Magazine, pp. 81-82, 140, Nov. 2000.

Weber, I., International Search Report for International Patent Application No. PCT/2010/020589, European Patent Office, dated Oct. 13, 2010.

(Continued)

*Primary Examiner* — Ajay Vasudeva

(74) *Attorney, Agent, or Firm* — Locke Lord LLP

(57) ABSTRACT

The present invention reduces loads and saves steel on topsides and grillage of a catamaran system by creating a lifting force from a barge to the topsides to offset a sagging bending moment of the self-weight on the topsides during transportation. The present invention can reduce the span of the supports on the topsides on the catamaran float-over barges and move the reaction forces toward inner edges of the float-over barges. The lifting force can cause a reduction of stress on the topsides' and grillage's members caused during the topside offloading and transportation. The stress reduction can result in the members withstanding the additional dynamic load caused by a catamaran system without increasing member sizes adequate for an offloading operation. The reduction results in a significant savings, given the size of a typical topsides for a Spar hull or other offshore structure.

33 Claims, 16 Drawing Sheets

U.S. PATENT DOCUMENTS

| | | | | |
|---|---|---|---|---|
| 4,825,791 | A | 5/1989 | Foster, Jr. et al. | |
| 6,132,143 | A * | 10/2000 | Hovinga et al. | 405/206 |
| 6,171,028 | B1 * | 1/2001 | Van Gelder | 405/209 |
| 6,347,909 | B1 * | 2/2002 | Kocaman | 405/209 |

FOREIGN PATENT DOCUMENTS

| | | | |
|---|---|---|---|
| FR | 2 514 317 | | 4/1983 |
| GB | 2165187 | A * | 4/1986 |
| GB | 2174743 | A * | 11/1986 |
| GB | 2306407 | A * | 5/1997 |
| GB | 2311042 | A * | 9/1997 |

OTHER PUBLICATIONS

Weber, I., Written Opinion for International Patent Application No. PCT/2010/020589, European Patent Office, dated Oct. 13, 2010.

Edelson, D., Luo, M. Halkyard, J. Smiley, D. "Kikeh Development: Spar Topside Floatover Installation." 2008 Offshore Technology Conference, May 5-8, 2008, Houston.

Technip. "Technip Reports Unprecedented Installation on Kikeh Spar." Rigzone News, Jan. 25, 2007 [retrieved from the Internet on Jan. 21, 2009 using <URL: http://www.rigzone.com/news/article.asp?a_id=40459>].

* cited by examiner

| | Self Weight | Preloading | Wave Load | Maximum Combined Load | Minimum Combined Load |
|---|---|---|---|---|---|
| Without Preloading | $0.125qL^2$ | 0 | +/- $M_{wave}$ | $0.125qL^2 + M_{wave}$ | $0.125qL^2 - M_{wave}$ |
| With Preloading | $0.125qL^2$ | -Pa | +/- $M_{wave}$ | $0.125qL^2 - Pa + M_{wave}$ | $0.125qL^2 - Pa - M_{wave}$ |
| Reduction | | | | Pa | Pa |

PRELOADING TO REDUCE LOADS AND SAVE STEEL ON TOPSIDES AND GRILLAGE OF CATAMARAN SYSTEMS

CROSS REFERENCE TO RELATED APPLICATIONS

This application is a continuation-in-part of U.S. application Ser. No. 12/359,860, filed Jan. 26, 2009, and is incorporated herein by reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The invention disclosed and taught herein relate generally to topsides for offshore structures and related installation methods and systems; and more specifically related installation methods and systems to preloading float-over barges to reduce loads and save steel on topsides and grillage of catamaran systems.

2. Description of the Related Art.

A Spar platform is a type of floating oil platform typically used in very deep waters and is among the largest offshore platforms in use. A Spar platform includes a large cylinder or hull supporting a typical rig topsides. The cylinder however does not extend all the way to the seafloor, but instead is moored by a number of mooring lines. Typically, about 90% of the Spar is underwater. The large cylinder serves to stabilize the platform in the water, and allows movement to absorb the force of potential high waves, storms or hurricanes. Low motions and a protected center well also provide an excellent configuration for deepwater operations. In addition to the hull, the Spar's three other major parts include the moorings, topsides, and risers. Spars typically rely on a traditional mooring system to maintain their position.

Deck or topsides installation has always been a challenge for floating structures, particularly in deep draft floaters like the Spar, which must be installed in relatively deep water. In the past heavy lifting vessels ("HLV"), including but not limited to, derrick barges have been used for topsides installations.

In traditional efforts, the topsides requires multi-lifting, for example five to seven lifts, to install the whole topsides due to the lifting capacity of available HLV. Due to multi-lifting, the steel weight per unity area of the topsides can be higher than that of topsides of fixed platforms installed with a single lifting. If the weight of the topsides is reduced, the weight of the Spar hull may also be reduced. The same principles are applicable to other offshore structures to which a topsides can be mounted.

Recently catamaran float-over systems have been used to install a topsides onto a Spar platform. A float-over method is a concept for the installation of the topsides as a single integrated deck onto a Spar hull in which the topsides is first transferred from a single barge onto at least two float-over barges (called "offloading") and transported with the float-over barges to the installation site for the Spar hull. At the installation site, the float-over barges are positioned on both sides of the Spar hull with the Spar hull below the topsides, the elevation is adjusted between the topsides and the Spar hull, and the topsides is installed to the Spar hull. Installation of the topsides to the Spar hull by the float-over method can allow a high proportion of the hook-up and pre-commissioning work to be completed onshore prior to load-out, which can significantly reduce both the duration and cost of the offshore commissioning phase. The float-over installation method allows for the installation of the integrated topsides or production deck on a fixed or floating structure without any heavy lift operation.

However, to accomplish the catamaran float-over procedure, the float-over barges are necessarily separated. During loading and transportation to the desired location for float-over and installation of a topsides on a Spar hull, the catamaran system is subjected to several loading conditions primarily due to wave action on the separated barges. These loading conditions would not occur with a single barge loaded with the topsides on deck, but such a single barge arrangement would not be conducive to a float-over installation of the topsides.

FIGS. 1A-1B illustrates two major different modes of loading. FIG. 1A is a schematic top view of a racking load on a catamaran system used to install topsides on a Spar hull. FIG. 1B is a schematic end view of a lateral bending load on the catamaran system. The figures will be described in conjunction with each other. In general, a catamaran system includes at least a pair of barges 115*a*, 115*b* (generally 115). A fabricated topsides 110 is removably coupled to the barges 115 through a supporting structure, referenced herein as a grillage system 125*a*, 125*b* (generally 125) mounted to the barges 115*a*, 115*b*, respectively. Different loads 101-102 occur on the catamaran system 100 that are not prevalent in a single barge system. These loads can include (i) racking moments 101*a*, 101*b* (generally 101), as shown in FIG. 1A, where the barges 115 are prone to twist relative to each other in response to wave loads causing stresses on the system; and (ii) lateral bending moments 102*a*, 102*b* (generally 102), as shown in FIG. 1B, where the barges 115 are prone to twist laterally in response to wave loads causing stresses on the system. The catamaran system 100 generally behaves as a rigid body when it is subjected to head and beam seas. Wave diffraction on single body catamaran system 100 has been performed to calculate the hydrodynamic load on this system.

To withstand these different loads particular to a catamaran system, the members used to construct the topsides and the grillage system are strengthened generally by an increase in size, adding weight and expense, compared to a single barge system with the topsides loaded onto the single barge. Because a topsides is generally a functioning micro-city suitable for extensive periods for working crews and other personnel, the topsides structure is relatively a significant size. An overall increase in size of even a small percentage can become a significant increase in actual expense.

There remains then a need to provide a catamaran system for a float-over procedure with a topsides, but more efficiently use the weight and strength of the members in the catamaran system to reduce weight and costs.

BRIEF SUMMARY OF THE INVENTION

The present invention reduces loads and saves steel on topsides and grillage of a catamaran system by creating a lifting force from a barge to the topsides to offset a sagging bending moment of the self-weight on the topsides during transportation. The present invention can reduce the span of the supports on the topsides on the catamaran float-over barges and move the reaction forces toward inner edges of the float-over barges. The size of the members of the topsides and grillage that typically would be necessary to withstand the various forces during the float-over procedure and transporting on the float-over barges to a desired location can be reduced as a result. The lifting force can cause a reduction of stress on the topsides' and grillage's members caused during the topside offloading and transportation. The stress reduction can result in the members withstanding the additional dynamic load caused by a catamaran system without increasing member sizes adequate for an offloading operation. The reduction results in a significant savings, given the size of a typical topsides for a Spar hull or other offshore structure.

The disclosure provides a method of preloading a catamaran system to reduce loading and material on a topsides for an offshore structure, comprising: positioning a topsides having a weight between at least two float-over barges so that a center of the topsides is laterally disposed between the barges; adding a ballast to a portion of the barges disposed toward the center of the topsides to create a downward bias on the portion of the barges; coupling a bracing member between the topsides and each barge at the portion that is downwardly biased; transferring the topsides to the float-over barges; and adjusting the downward bias of the ballast to create an upward force from the barges through the bracing member to the topsides to reduce a sagging bending moment caused by the weight of the topsides.

The disclosure also provides a method of preloading a catamaran system to reduce loading and material on a topsides for an offshore structure, comprising: transferring a topsides having a weight onto at least two float-over barges with a ballast so that a center of the topsides is laterally disposed between the barges; installing one or more bracing members between the topsides and each barge with the ballast; and adjusting the ballast to create a lifting force from the barges through the bracing members to the topsides to reduce a sagging bending moment caused by the weight of the topsides.

The disclosure further provides a catamaran system created for an offshore structure, comprising: a topsides having a weight and adapted to be installed onto the offshore structure; at least two float-over barges adapted to support the topsides, the topsides being coupled to each of the barges with the barges being spaced apart from each other so that a center of the topsides is disposed between the barges, the barges comprising a ballast adapted to create a downward bias on a portion of the barges disposed toward the center of the topsides; and a bracing member coupled between the topsides and each barge at the portion, the bracing member being coupled when the portion is downwardly biased, the ballast further being adjustable to at least partially reduce the downward bias and create a lifting force on the topsides through the bracing member to counteract a sagging bending moment caused by the weight of the topsides.

DETAILED DESCRIPTION

Figure 1A:
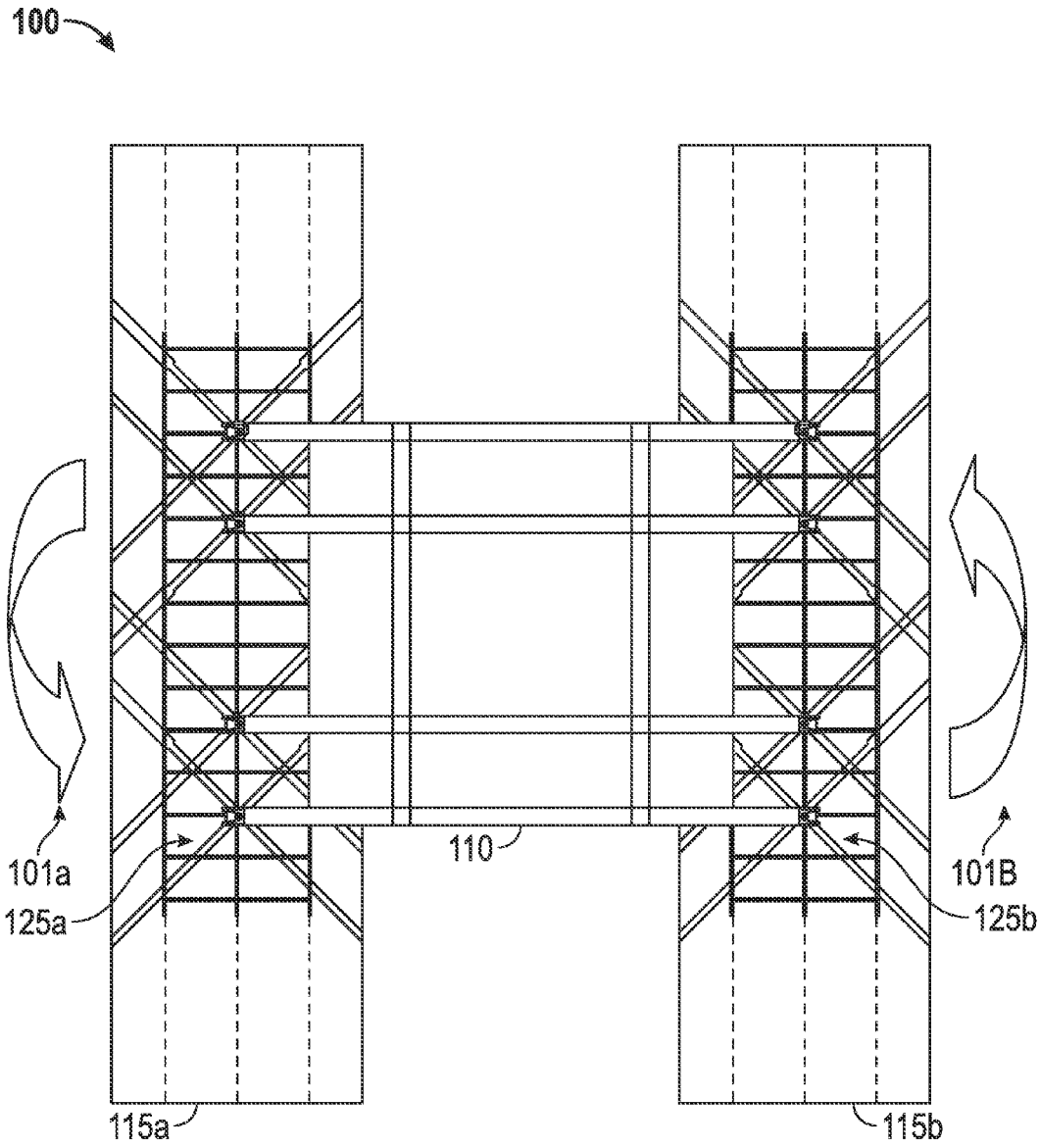
FIG. 1A is a schematic top view of a racking load on a catamaran system used to install topsides on a Spar hull or other offshore structure.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, elements have been labeled with an "a" or "b" to designate one side of the system or another. When referring generally to such elements, the number without the letter is used. Further, such designations do not limit the number of elements that can be used for that function.

The float-over catamaran installation of the topsides onto an offshore structure, such as a Spar hull, can involve several major steps. The Figures illustrate various steps of an exemplary procedure to achieve preloading on a catamaran system that can be used to install one or more topsides on an offshore structure. Each figure will be described below.

A first step is to load the topsides from the fabrication yard onto the deck of a transportation barge and then tow the transportation barge from the fabrication yard to a sheltered location, including, but not limited to, a quayside location. A quayside location is a structure built parallel to the bank of a waterway for use as a landing place. A second step is to transfer the topsides from the transportation barge to at least one float-over barge, and generally at least two float-over barges, at the sheltered quayside to create a catamaran system that will be used to install the topsides on a Spar hull.

Figure 2A:
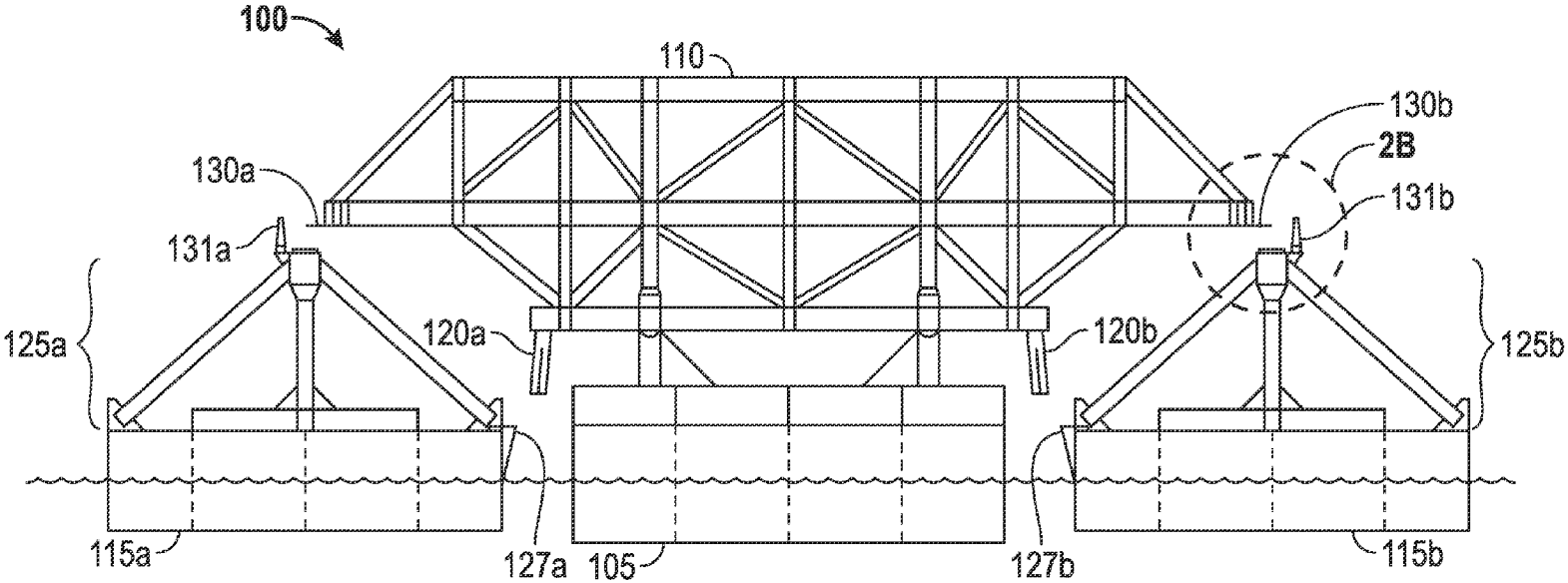
FIG. 2A is a schematic end view of an exemplary embodiment of a topsides being offloaded from single transportation barge to two float-over barges.
Figure 2B:
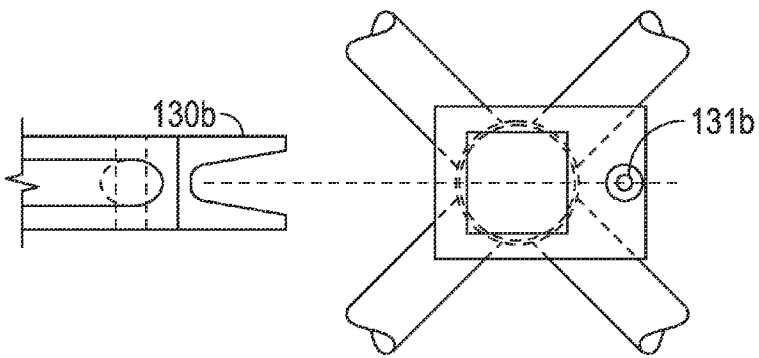
FIG. 2B is a schematic top view of a detail portion of the topsides from FIG. 2A to be coupled with a portion of the grillage system.

FIG. 2A is a schematic end view of an exemplary embodiment of a topsides being offloaded from single transportation barge to two float-over barges. FIG. 2B is a schematic top view of a detail portion of the topsides from FIG. 2A to be coupled with a portion of the grillage system. The figures will be described in conjunction with each other.

A single transportation barge 105 can be loaded with the topsides 110 from a fabrication facility and towed and offloaded to the float-over barges 115*a* and 115*b* (generally 115) that together with the topsides creates a catamaran system 100 for towing or otherwise transporting the topsides to the Spar hull (not shown). The float-over barges 115 are designed to provide buoyancy for the load of the topsides 110 and withstand environmental load of sea and weather conditions during the catamaran towing of the topsides to the Spar hull.

Each of the two barges 115 has a grillage system, 125*a* and 125*b* (generally 125). The grillage system 125 generally has an array of beams and crossbeams with attachment points for the topsides, such as described below. In at least some embodiments, the grillage system is able to withstand the wave load from the topsides for a catamaran towing of Hs up to 5.6 m, where Hs is the significant wave height. Hs is approximately equivalent to the visually observed height of the wave and the measurements and calculations for loading of such wave heights would be known to a person of ordinary skill in the art.

The topsides 110 is provided with a fork 130*a*, 130*b* (generally 130) on the topsides. The grillage system 125 is provided with a tall installation guide pin 131*a*, 131*b* (generally 131). The forks 130 on the topsides are designed to guide the float-over barge's grillage systems 125 to a coupling position with the topsides using the installation guide pins 131.

A third step is installing sea fastening members to secure the grillage systems mounted to the float-over barges with the topsides. The nature of the fastening can create a solid hinge system that is bendable in response to loading on the topsides relative to the float-over barges.

Figure 3A:
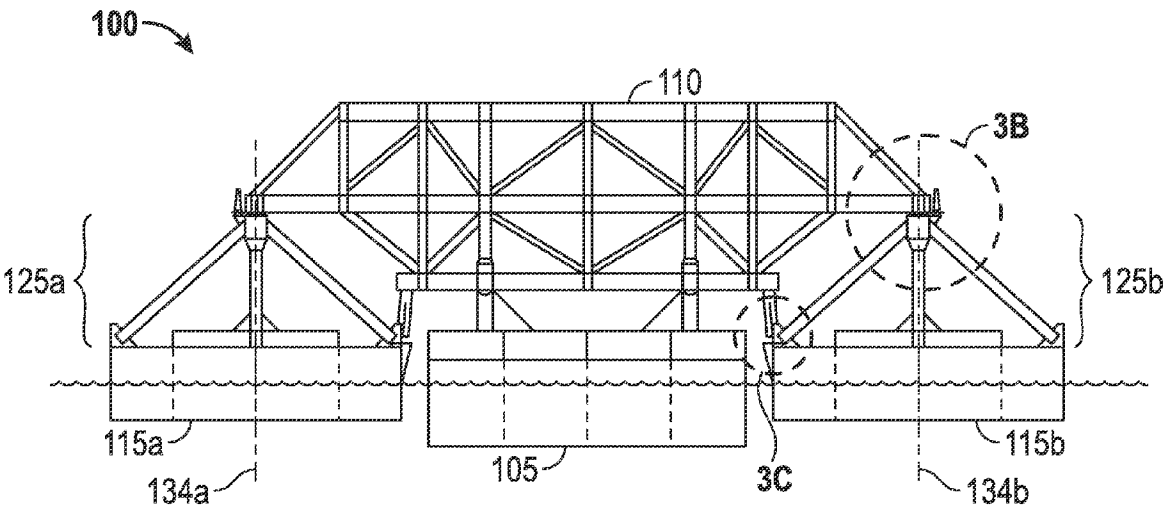
FIG. 3A is a schematic end view of an exemplary embodiment of a topsides coupled to the grillage system of the float-over barges.
Figure 3B:
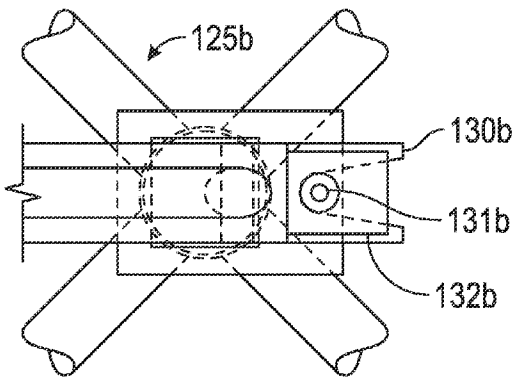
FIG. 3B is a schematic top view of a detail portion of the topsides and the grillage system from FIG. 3A with sea fastening coupled between a grillage top and the topsides.

FIG. 3A is a schematic end view of an exemplary embodiment of a topsides coupled to the grillage system of the float-over barges. FIG. 3B is a schematic top view of a detail portion of the topsides and the grillage system from FIG. 3A with sea fastening coupled between a grillage top and the topsides. The figures will be described in conjunction with each other.

The grillage system 125 can provide a number of hingeable couplings to connect with the topsides. The term "hingeable" coupling is used broadly and is not limited to a pair of plates rotating about an enclosed pin. For example, a hingeable coupling can include a bendable coupling that can flex and bend as needed or one that is constrained significantly in one plane and flexibly located in another plane. Examples are described herein. Also, it should be appreciated that a person of ordinary skill could design the grillage system with any number or type of supports and in any configuration to accomplish the goal of creating a catamaran system 100. As one example, when the fork 130 of the topsides is engaged with the guide pin 131 on a float-over barge, a locking plate 132*b* (generally 132) can be placed on the side of the guide pin opposite the fork 130 and welded or otherwise coupled to the fork to entrap the guide pin therebetween. This coupling of the fork 130 with the locking plate 132 restricts the horizontal movement between the topsides and the float-over barge, but still allows vertical or bending movement because the fork and the locking plate are not welded to the guide pin. Further, the fork can be made of plate steel, such as and without limitation 1 inch (25 mm) thick plate, that relative to the size of the topsides forms a bendable solid hinge 128*a*, 128*b* (generally 128) that can flex as needed for bending movement of the topsides relative to the float-over barges. In general, the topsides fork 130 and guide pin 131 will be coupled near a lateral center of gravity 134*a*, 134*b* (generally 134) of the barges 115*a*, 115*b*, respectively. The center of gravity will be generally the center of the barges from side to side when the barges are constructed symmetrically from side to side. The coupling can occur along the length of the barge at one or more points. When multiple points are used to couple the topsides to the barge through the grillage, the coupling can be made effectively at the center of gravity, for example, where two points might be equidistant from the center of the barges, so that the result is an effective coupling though the center of gravity.

Further, after the topsides' weight is transferred to the float-over barges 115, the middle single barge 105 can be pulled out. In general, the single barge 105 can be removed after the topsides is secured at least horizontally to the barges, such as with the locking plate 132.

In at least one embodiment, the topsides 110 can be supported by at least four locations with the forks/locking plates and guide pins along the length of each float-over barge 115.

However, a person of ordinary skill could design any number of supporting locations and mechanisms for the topsides 110 on the barges 115.

Figure 3D:
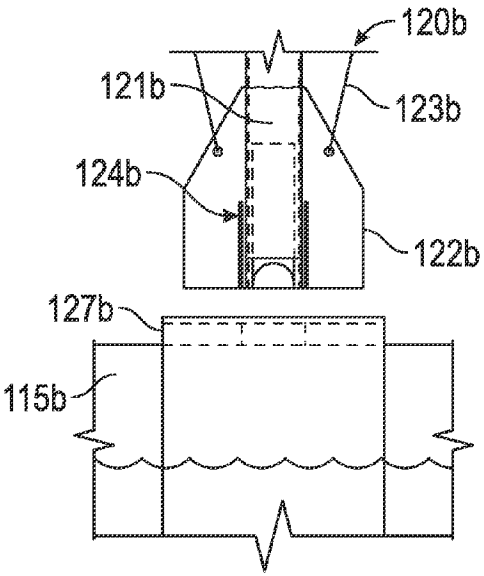
FIG. 3D is a schematic front view of the brace of FIG. 3C.
Figure 3C:
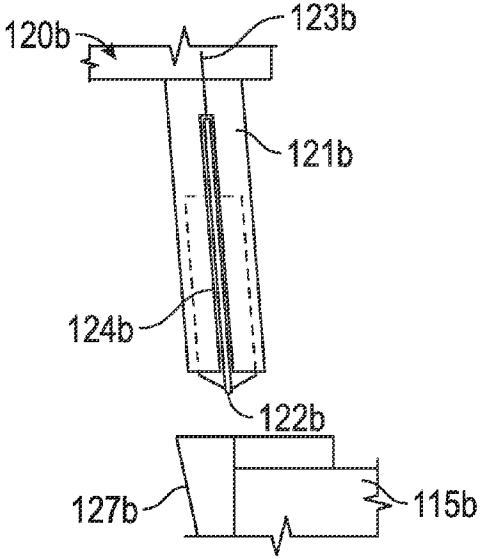
FIG. 3C is a schematic side view of a detail portion of a brace on the topsides from FIG. 3A with a link plate in a retracted position.

FIG. 3C is a schematic side view of a detail portion of a brace on the topsides from FIG. 3A with a link plate in a retracted position. FIG. 3D is a schematic front view of the brace of FIG. 3C. The figures will be described in conjunction with each other.

Another hingeable coupling at a hinge 129*a*, 129*b* (generally 129) between the topsides and float-over barges can be made by coupling a tie down brace 120*a*, 120*b* (generally 120 and also shown in FIG. 2A) between the topsides 110 and the grillage system 125. The brace 120 can include a center tubular member 121 b (generally 121) and a plate 122*b* (generally 122). The tubular member 121 can include a slot 124*b* (generally 124), shown particularly in FIG. 3C, through which the plate 122 is slidably coupled. One or more fasteners 123b (generally 123) such as wire rope or chain, can secure the plate 122 in a retracted position in the tubular member 121. Generally, the tie down braces 120 are not welded to the barges until the weight of the topsides is transferred from the single transportation barge to the float-over barges.

The tie down brace 120 can be positioned above a tie down structure 127*a*, 127*b* (generally 127) adjacent the barge inner edge in a retracted position shown in FIGS. 3C-3D. The brace 120 is generally disposed laterally inward from the center of gravity 134 of the barges toward a center of the topsides. In at least one embodiment, the brace 120 reduces the length of the supported topsides between the guide pins 131.

Figure 4A:
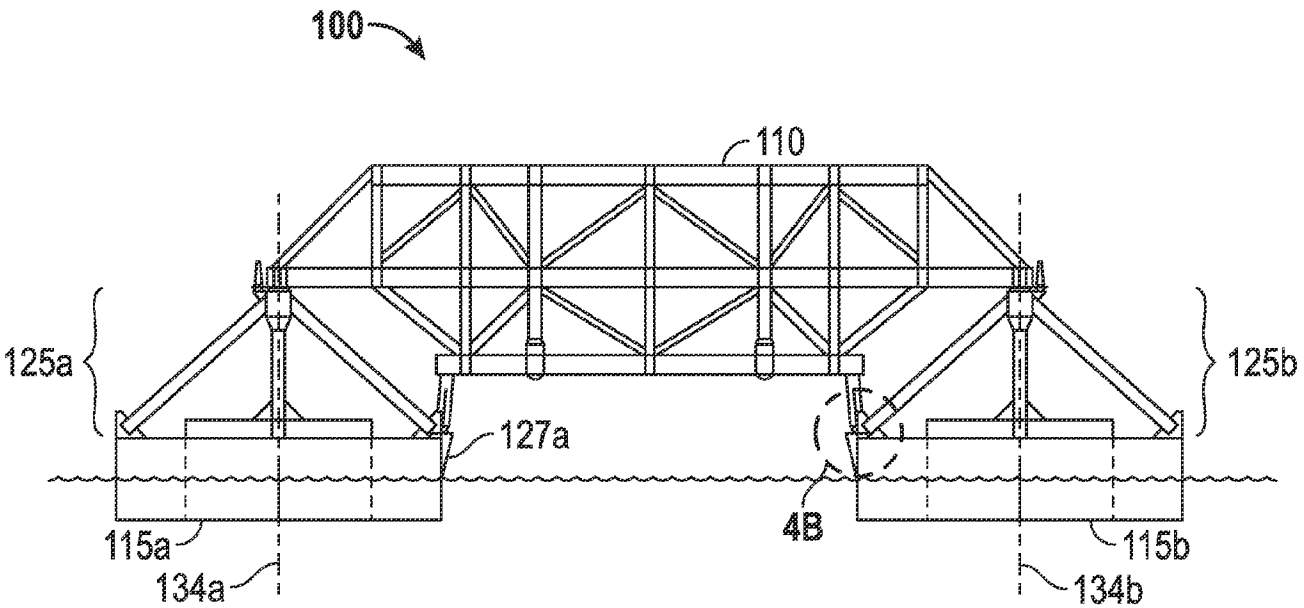
FIG. 4A is a schematic end view of an exemplary embodiment of a topsides coupled to the grillage system of the float-over barges after the single barge is removed.
Figure 4C:
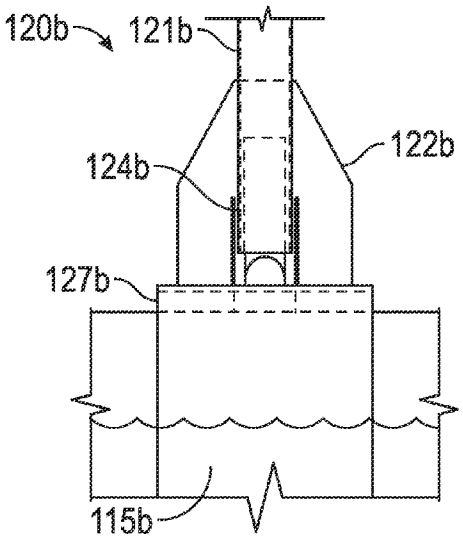
FIG. 4C is a schematic front view of a detail portion of the brace between the topsides and the float-over barge from FIG. 4B.
Figure 4B:
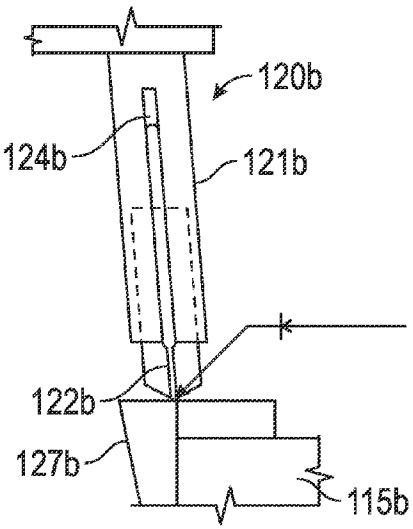
FIG. 4B is a schematic side view of a detail portion of the topsides from FIG. 4A coupled with sea fastening between the float-over barge and topsides in which a brace is lowered and installed.

FIG. 4A is a schematic end view of an exemplary embodiment of a topsides coupled to the grillage system of the float-over barges after a single barge is removed. FIG. 4B is a schematic side view of a detail portion of the topsides from FIG. 4A coupled with sea fastening between the float-over barge and topsides in which a brace is lowered and installed. FIG. 4C is a schematic front view of a detail portion of the brace between the topsides and the float-over barge from FIG. 4B. The figures will be described in conjunction with each other.

After the weight of the topsides 110 is transferred from the transportation barge to the float-over barges, the brace 120, specifically the plate 122, can be dropped down and welded to the tie down structure 127 on the barges 115, as shown in FIGS. 4B-4C. Further, the plate 122 can be welded to the tubular member 121, so that the coupling between the topsides and the grillage system is fixed in length. In at least one embodiment, the plate 122 can be made of two thin side plates welded to the support structure and one thicker middle plate with stiffeners coupled to the support structure, that relative to the size of the topsides forms a bendable solid hinge that can flex as needed for bending movement of the topsides relative to the barges.

The grillage system 125 of supports and braces make the topsides-barge system similar to a rigid catamaran with hinged links at sea fastening members, such as the fork 130/locking plate 132 and brace 120, thus creating the catamaran system 100.

A fourth step is adding ballast to the barges to at least partially counteract a sagging bending moment exerted on the barges by the topsides. The sagging bending moment generally is the mathematical product of the weight of the topsides acting at a support distance between the barges, described in more detail herein. The ballast can be added by pumping ballast into exterior tanks or by placing ballast on the float-over barges' deck to create a counteracting moment against the sagging moment of the topsides. The ballast can be liquid or solid. Further, the term "adding ballast" is to be broadly construed and can include redistributing ballast or other weight on the barge to create the counteracting moment against the sagging bending moment, described herein.

Figure 5A:
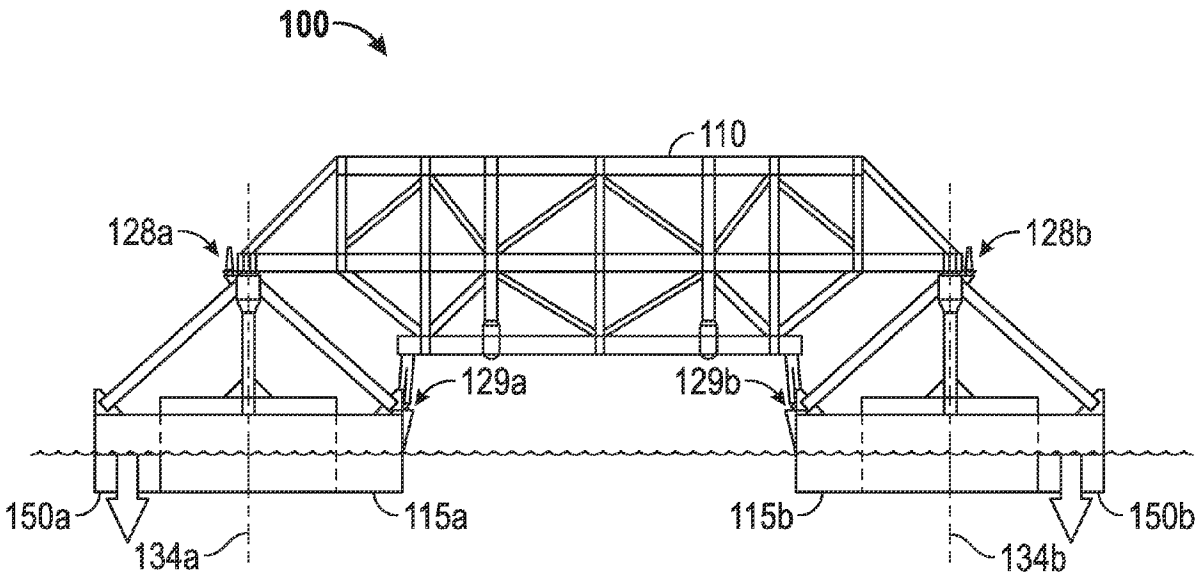
FIG. 5A is a schematic end view of the catamaran system with a ballasted pair of barges that are coupled to the topsides.

FIG. 5A is a schematic end view of the catamaran system with a ballasted pair of barges that are coupled to a topsides. A ballast 150*a*, 150*b* (generally 150) is loaded into or onto the float-over barges 115 or otherwise coupled thereto. The ballast 150 can be a variety of weighty substances, including sea water, fresh water, or other liquids. Further, the ballast 150 can be solid ballast. In general, the ballast 150 is installed on the float-over barges 115 after the catamaran system 100 is formed with the topsides 110 coupled to the barges 115. The ballast is generally preloaded with the barges prior to the barges and topsides being transported to the site of the Spar hull. The extent of preloading depends on the barge capabilities of strength and available buoyancy. In general, the ballast will be loaded along the length of the barge, although in some embodiments, the ballast can be loaded along portions of the length of the barge.

Generally, the ballast will be loaded laterally outward from the center of gravity 134 of the barges, which generally will be outward from the centerlines of the barges when the barges are symmetrically constructed. Loading outward from the barge's center of gravity creates a counteracting moment toward the center of the topsides that provides a lifting force to the inside portions of the barge and thence to the topsides coupled to the barge.

Figure 5B:
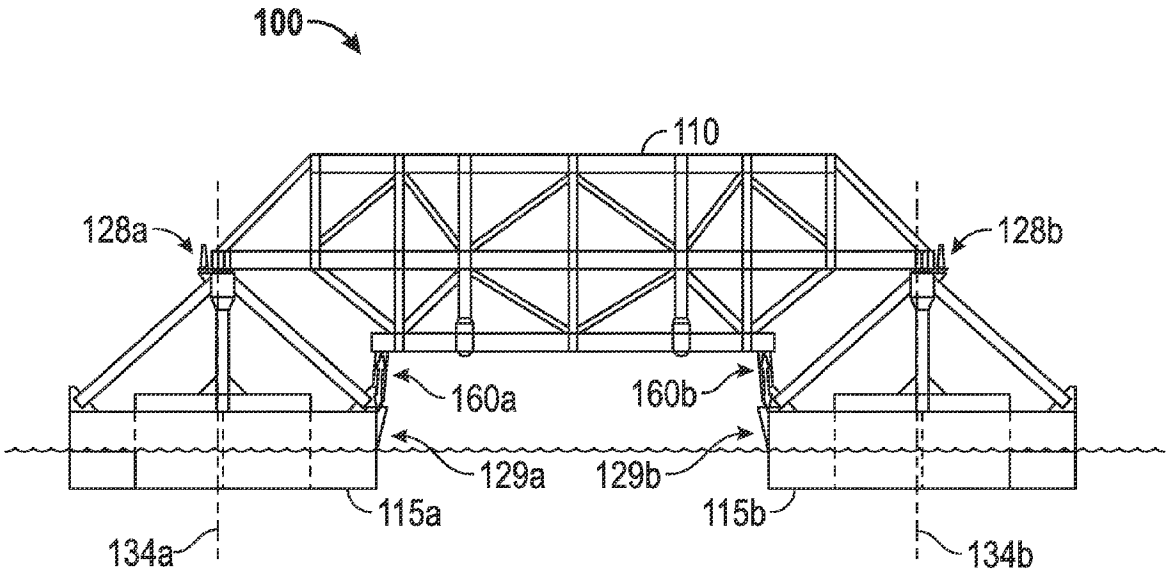
FIG. 5B is a schematic end view of the catamaran system with an alternative preloading on tie down braces that are coupled to the topsides.

FIG. 5B is a schematic end view of the catamaran system with an alternative preloading on tie down braces that are coupled to the topsides. The topsides and barges can be coupled with the tie down brace 120. A jack system 160 can be coupled to the brace. The jack system can exert a pushing reaction load between the inner edge of the barges and the topsides on each brace to preload the system and reduce the stress on the topsides' members.

Figure 6:
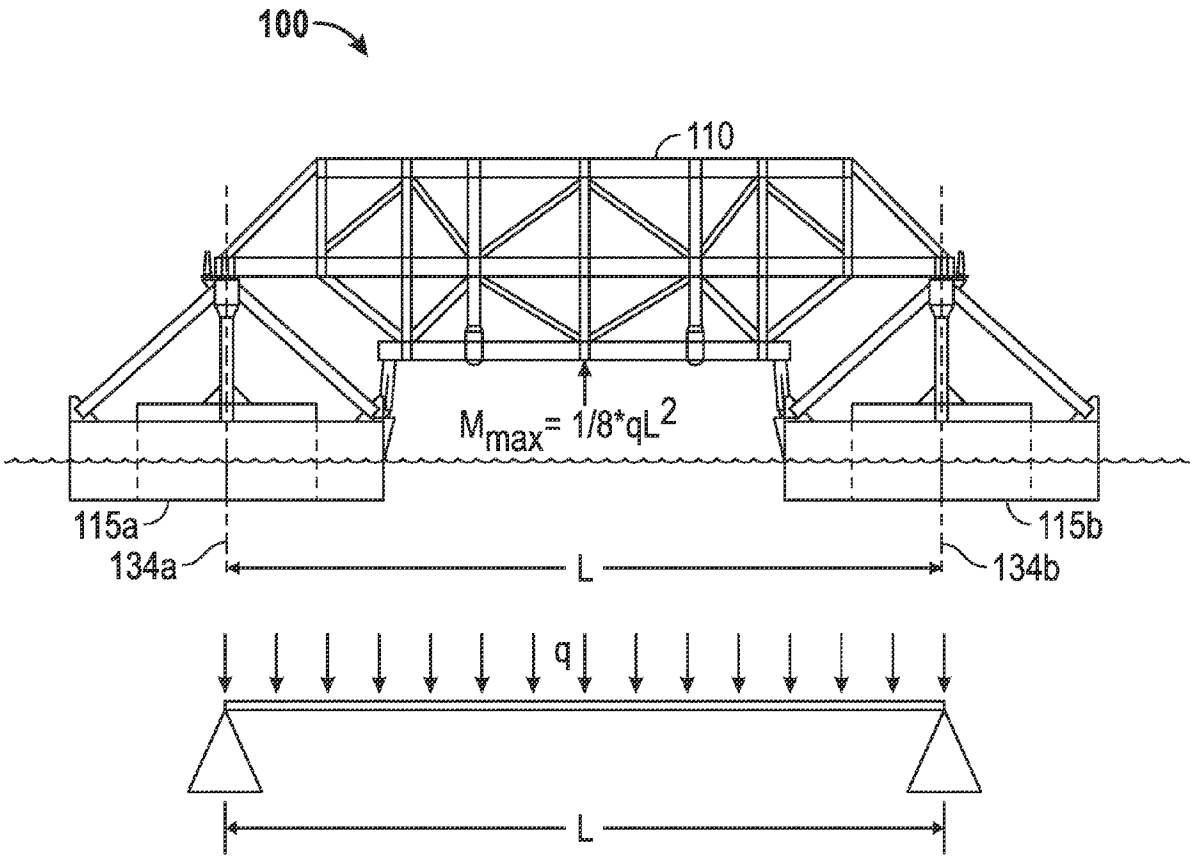
FIG. 6 is a schematic end view of an exemplary embodiment of the catamaran system without the ballast 150, showing loading calculations.

FIG. 6 is a schematic end view of an exemplary embodiment of the catamaran system without the ballast 150, showing loading calculations. The barges 115 are coupled with the topsides 110 to form the catamaran system 100. The suspended portion of the topsides between the centers of gravity of the barges is subject to a sagging bending moment due to gravity effects on the suspended mass. In general, the sagging bending moment applied on the topsides without preloading ballast can be represented as $0.125\ qL^2$, where q is equivalent linear load on deck and L is the distance between coupling locations on the barges (that is, the effective centers of gravity, which can be the barges' centerlines when the barges are built symmetrically across its lateral cross section). The equivalent linear load is the weight of the topsides, assumed to be distributed evenly across the suspended length L.

Figure 7:
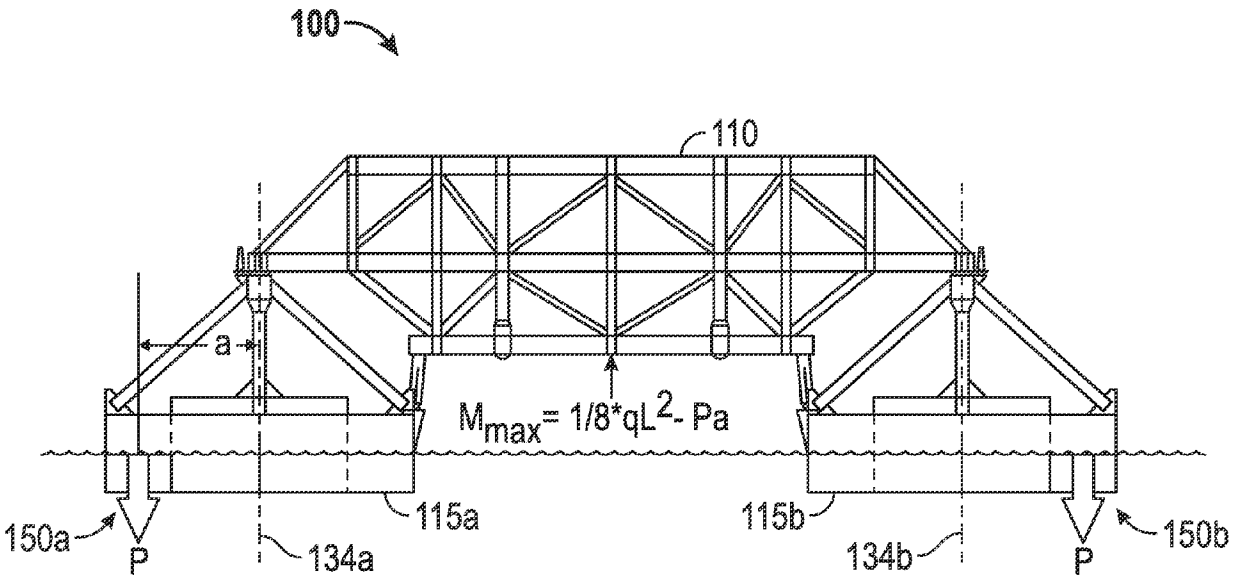
FIG. 7 is a schematic end view of an exemplary embodiment of the catamaran system with the ballast 150, showing loading calculations.

FIG. 7 is a schematic end view of an exemplary embodiment of the catamaran system with the ballast 150, showing loading calculations. In FIG. 6, the ballast 150 having a weight of P on each barge at a distance "a" from the center of gravity 134 creates a counteracting moment 150 as the mathematical product of P and a or "Pa", where P is weight of ballast installed on each barge. Thus, with ballast 150*a* and 150*b* (generally 150), the sagging bending moment is reduced to $0.125\ qL^2$-Pa. With a reduced sagging bending moment, the topsides can be designed lighter and more efficiently.

For example and without limitation, the inventor has determined that approximately 100 kg $m^2$ or more of steel for the topsides area can be saved with an exemplary Spar topsides weight of about 20,000 metric tonnes (MT). Stated differently, an estimated 5% to 10% increase in steel is typical and understood to be necessary to provide structural integrity to the topsides when a float-over process is used. This 5% to 10% penalty can be reduced or eliminated with the use and teachings of the present invention.

Figures 8, 9A:
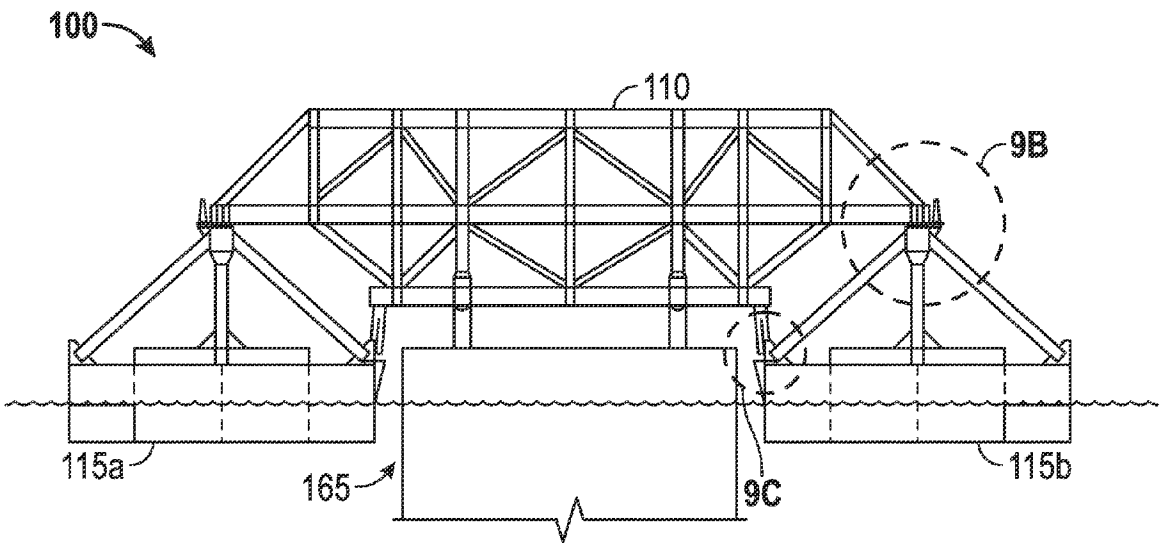
FIG. 8 is a chart illustrating the beneficial effect of the counteracting moment according to the present invention.
FIG. 9A is a schematic end view of the catamaran system floating over an offshore structure, such as a Spar hull.

FIG. 8 is a chart illustrating the beneficial effect of the counteracting moment according to the present invention. The table also includes a moment created by the wave action on the catamaran system, Mwave, which can be calculated and is known to those with ordinary skill in the art. The Mwave calculation is not believed relevant to the purposes of the present invention and is only shown to illustrate that broader calculations are needed for determining the ultimate loads that the catamaran system 100 will face in actual use, in addition to the adjustments advantageously afforded by the present invention.

Figure 1B:
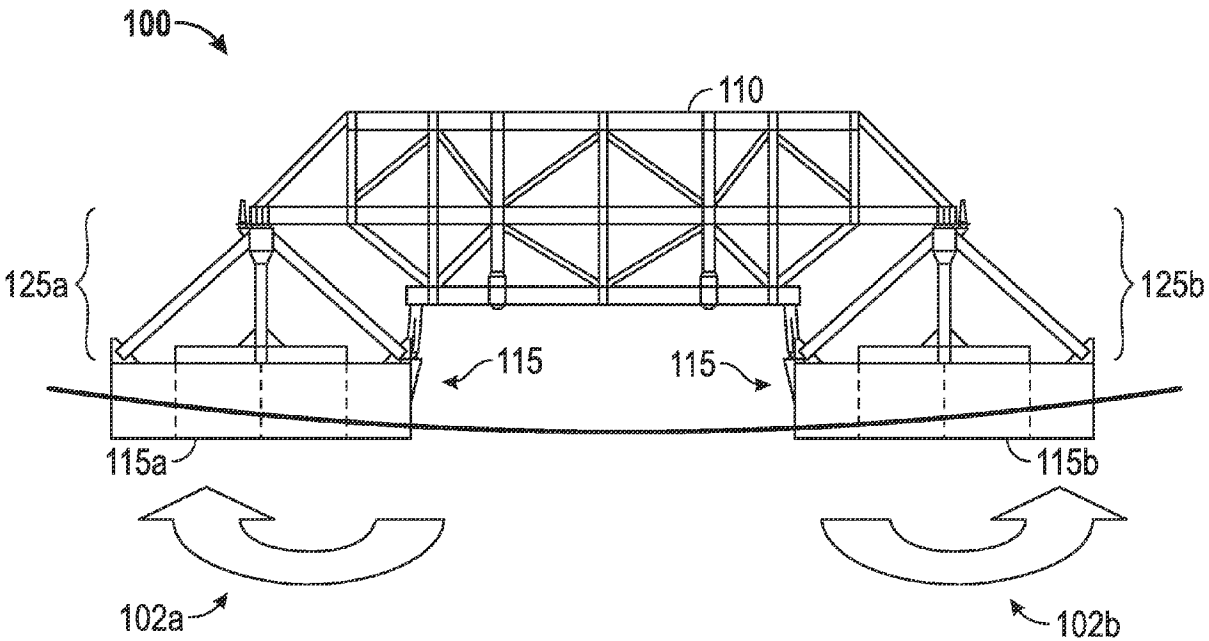
FIG. 1B is a schematic end view of a lateral bending load on the catamaran system.

A fifth step is transporting the catamaran system to the location near to the Spar hull. During this step, the above described loads in FIGS. 1A-1B can have serious effects on the catamaran system without either proper structure or proper counteracting moments to reduce the loads, as described herein. Before arrival to the location, the Spar hull is ballasted down deep enough to leave ample clearance for the topsides 110 to float over. Upon arrival, the fifth step can include the mooring and lashing setup between the catamaran system 100 with the topsides 110 and the pre-installed Spar hull at the site.

Figure 9C:
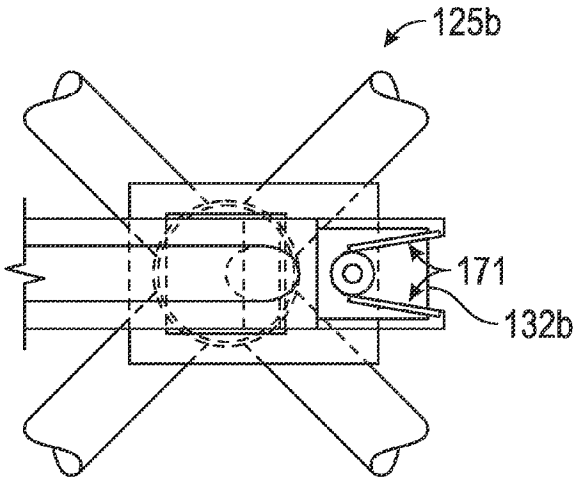
FIG. 9C is a schematic top view of a detail portion of the topsides from FIG. 9A with the sea fastening between barge and pre-installed brace of the topsides 15 removed.
Figure 9B:
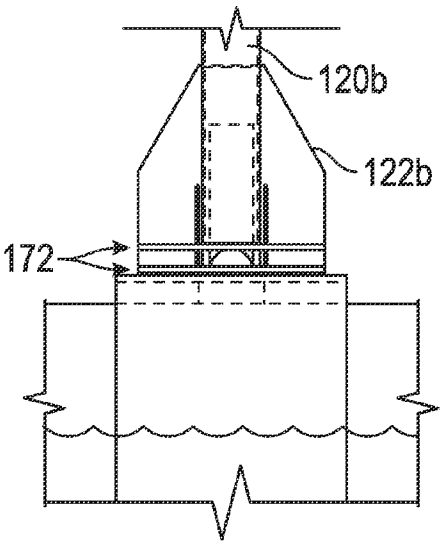
FIG. 9B is a schematic top view of a detail portion of the topsides from FIG. 9A with the sea fastening between grillage top and topsides removed.

FIG. 9A is a schematic end view of the catamaran system floating over an offshore structure, such as a Spar hull. FIG. 9B is a schematic top view of a detail portion of the topsides from FIG. 9A with the sea fastening between grillage top and topsides removed. FIG. 9C is a schematic top view of a detail portion of the topsides from FIG. 9A with the sea fastening between barge and pre-installed brace of the topsides removed. The figures will be described in conjunction with each other.

A sixth step is transferring the topsides to the offshore structure, such as a Spar hull. In general, the offshore structure 165 is at least partially de-ballasted, such that weight of the topsides 110 can be gradually and safely transferred to supports at the top of the offshore structure. Once at least the partial weight of the topsides 110 is transferred from the barges 115 to the offshore structure 165, the braces 120 between the topsides 110 and the barges 115 can be cut or the welds can be removed, for example at locations 172, so that the brace is uncoupled, as shown in FIG. 9B. After uncoupling the brace, the topsides 110 is supported primarily at the fork/locking plate locations on the barges 115. The locking plates 132 may be cut, for example at locations 171, to allow the barges to be pulled away from topsides, as shown in FIG. 9B. The lashing lines can then be detached. Once the barges are free from the forks 130, the barges 115 can be pulled away from the offshore structure.

Figure 10A:
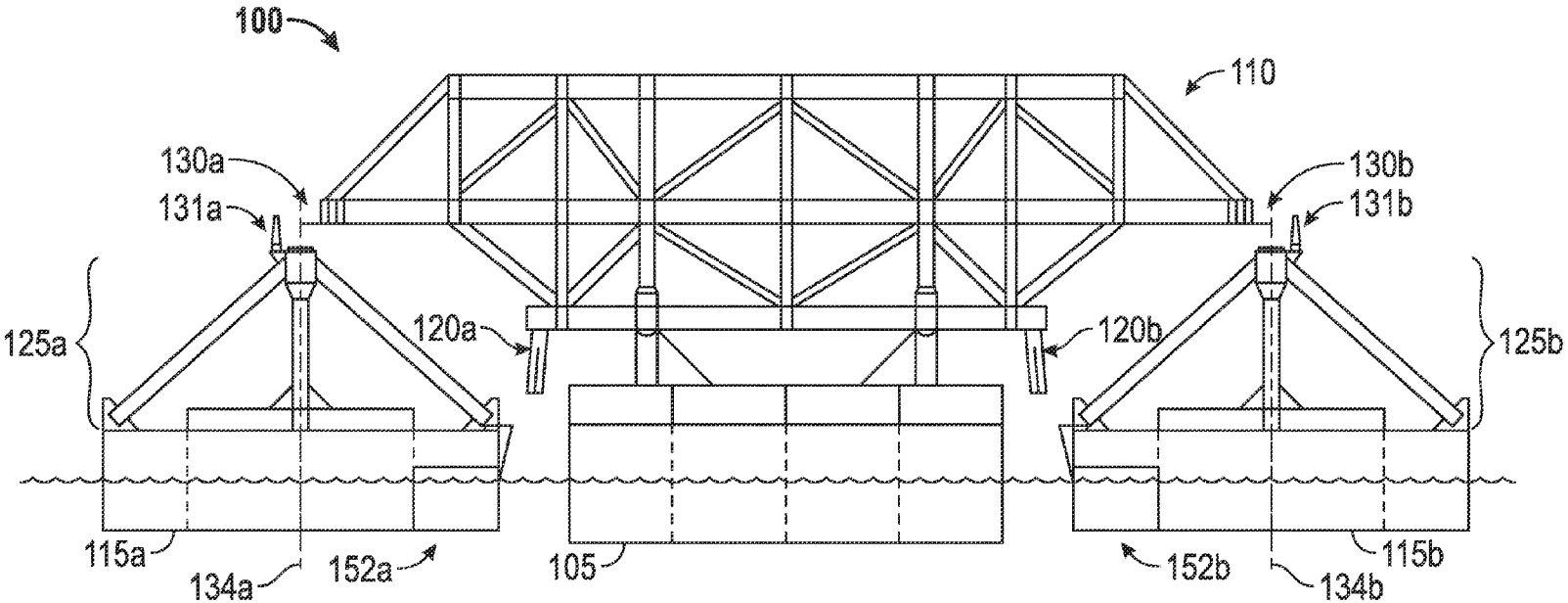
FIG. 10A is a schematic end view of another exemplary embodiment of a topsides being offloaded from single transportation barge to two float-over barges.
Figure 10B:
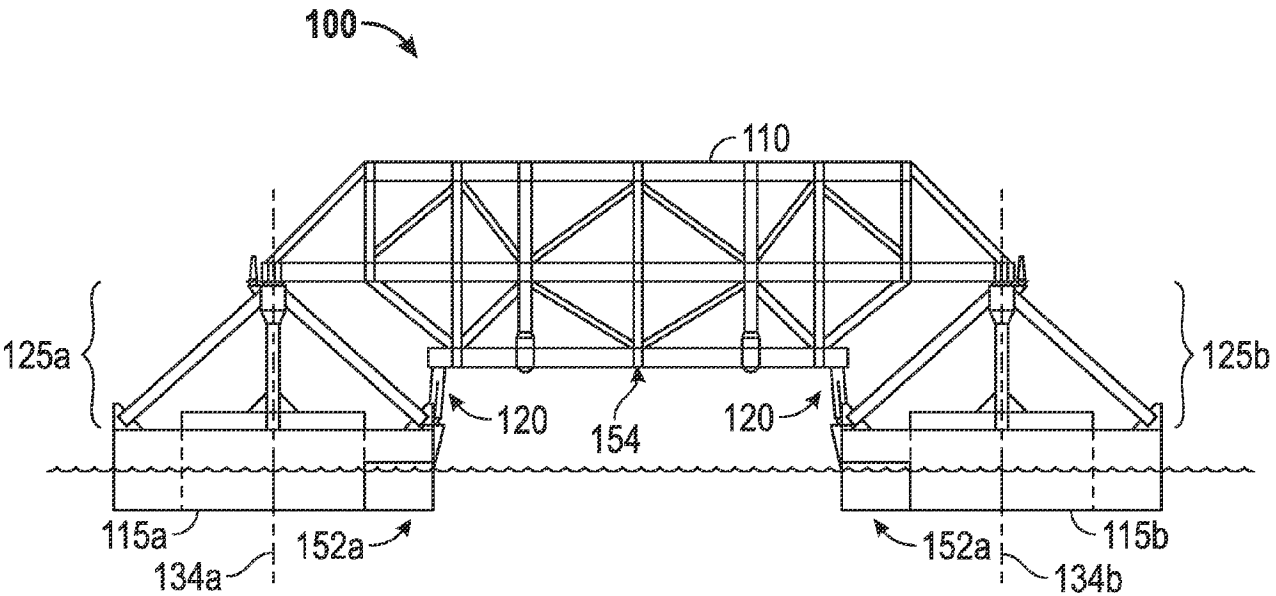
FIG. 10B is a schematic end view of an exemplary embodiment of a topsides coupled to the grillage system of the float-over barges with ballast after the single barge is removed.
Figure 10C:
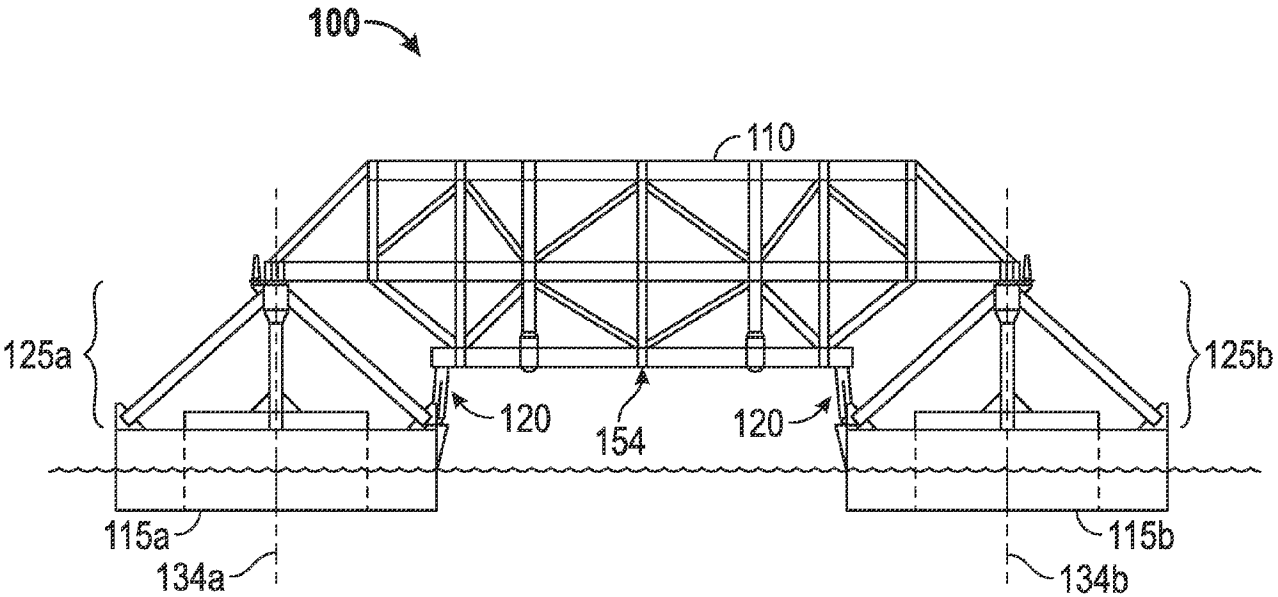
FIG. 10C is a schematic end view of the catamaran system with float-over barges that are coupled to the topsides in a transportation configuration.

FIG. 10A is a schematic end view of another exemplary embodiment of a topsides being offloaded from single transportation barge to two float-over barges. FIG. 10B is a schematic end view of an exemplary embodiment of a topsides coupled to the grillage system of the float-over barges with ballast after the single barge is removed. FIG. 10C is a schematic end view of the catamaran system with float-over barges that are coupled to the topsides in a transportation configuration. The figures will be described in conjunction with each other.

The structure of the grillage system, sea fastening members, float-over barges, and topsides are similar to the structure described above with the primary difference in this embodiment of the location of the ballast and sequence of coupling the sea fastening members, particularly a bracing member such as the tie-down brace, with the effects of the ballast at the different location. In this embodiment, the float-over barges can include a ballast 152*a*, 152*b* (generally 152) loaded laterally inwardly from the center of gravity 134 of the barges and toward the center 154 of the topsides disposed between the barges. The ballast 152 will generally be disposed laterally inward from the centerlines of the barges, when the barges are symmetrically constructed. The ballast 152 can be of the same kind of ballast (liquid or solid) as described for ballast 150 above. In general, the ballast 152 is installed at some time prior to the coupling of the tie-down brace 120*a*, 120*b* to the barges 115*a*, 115*b*, respectively. The ballast can be preinstalled prior to moving the float-over barges from a dock yard or at any time prior to coupling the tie-down braces to the barges. After coupling the tie-down braces, the ballast 152 can be at least partially removed or moved to another location, resulting in the barges exerting a lifting force on the topsides through the tie-down braces to counter the sagging bending moment of the weight of the topsides.

In more detail, the single transportation barge 105, loaded with the topsides 110, is towed to be offloaded to the float-over barges 115*a* and 115*b*, as shown in FIG. 2A. The subset of sea fastening members of the fork 130, guide pin 131, and locking plate 132, shown in FIG. 3B can be coupled between the topsides and the grillage system. The ballast 152 can be loaded inward from the barges' center of gravity 134 to create an outwardly directed moment on the barges and generally cause a downward bias to tilt portions of the barges that are disposed inwardly of the centerline in a downward direction and vertically away from the topsides. The moment and resulting downward bias created by the ballast 152, shown in FIG. 10A, provides an additional spacing between the topsides' structure and the barges' structure inward of the center of gravity 134 compared to the spacing without the ballast 152. While in that biased position, a bracing member such as the tie-down brace 120 can be coupled with the tie-down structure 127 as shown and described in FIGS. 4B and 4C. Then, the downward bias can be adjusted by reducing or removing the ballast 152 to cause the barges to become at least partially unbiased and rise from its titled position to exert a compressive force on the tie-down brace 120. The compressive force causes a lifting force from such portions of the barges to the topsides coupled to the barges for the preloading that has been described above. As an alternative, the downward bias on the barge can be adjusted by adding the ballast 150 as described above to counteract the ballast 152 (so the ballast 152 need not be removed) and cause a similar result of preloading on the tie-down brace 120 and thence to the topsides. As a further alternative, the downward bias can be adjusted by moving the ballast 152 to another portion of the barge to reduce the downward bias on the portion of the barge. Such an alternative includes moving the ballast 152 to the location of the ballast 150 described above to create an additional amount of upward force through the tie-down brace to the topsides by effectively substituting the ballast 152 for the ballast 150. The resulting catamaran system can be transported to the location near to the Spar hull or other offshore structure, so the topsides can be transferred to the offshore structure as described above with the sea fastening members decoupled, as shown and described in FIGS. 9B and 9C.

Other and further embodiments utilizing one or more aspects of the inventions described above can be devised without departing from the spirit of Applicant's invention. Further, the various methods and embodiments of the catamaran system can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A method of preloading a catamaran system to reduce loading and material on a topsides for an offshore structure, comprising:

positioning a topsides having a weight between at least two float-over barges spaced apart from each other so that a center of the topsides is laterally disposed between the barges;

adding a ballast to a portion of the barges disposed toward the center of the topsides to create a downward bias on the portion of the barges;

coupling a bracing member between the topsides and each barge at the portion that is downwardly biased;

transferring the topsides weight to the float-over barges; and adjusting the bias of the ballast to create an upward force from the barges through the bracing member to the topsides to reduce a sagging bending moment applied on the topsides that is caused by the weight of the topsides suspended between the float-over barges, the float-over barges supporting the topsides at least partially above a surface of water.

2. The method of claim 1, wherein adding the ballast further comprises preinstalling the ballast prior to positioning the topsides between the float-over barges.

3. The method of claim 1, wherein adjusting the downward bias of the ballast further comprises at least partially removing the ballast.

4. The method of claim 1, wherein adjusting the downward bias of the ballast further comprises at least partially moving the ballast to another portion of the barge.

5. The method of claim 1, wherein adjusting the downward bias of the ballast further comprises adding another ballast to the barge to counteract the downward bias.

6. The method of claim 1, wherein adding the ballast to the barges comprising adding the ballast inwardly from a lateral center of gravity of the barges.

7. The method of claim 6, wherein adjusting the downward bias of the ballast further comprises adding another ballast to the barge outwardly from the lateral center of gravity of the barges.

8. The method of claim 1, further comprising transporting the catamaran system to a location for installing the topsides on the Spar hull.

9. The method of claim 1, wherein adding the ballast comprises adding the ballast along the length of the barges.

10. The method of claim 1, further comprising coupling a locking plate at least partially around a guide pin installed between each of the barges and the topsides, the grillage system, or a combination thereof to maintain a lateral coupling of the topsides with the barges.

11. The method of claim 1, wherein adding the ballast to the portion of the barges comprises pumping fluid into one or more tanks on the barges.

12. The method of claim 1, wherein adding the ballast to the portion of the barges comprises adding solid ballast to the barges.

13. The method of claim 1, wherein coupling the bracing member between the topsides and each barge comprises hingeably coupling the topsides with the barges.

14. The method of claim 1, wherein adjusting the downward bias of the ballast comprises redistributing a weight of the barges to counteract the sagging bending moment.

15. A method of preloading a catamaran system to reduce loading and material on a topsides for an offshore structure, comprising:

transferring a topsides having a weight onto at least two float-over barges with a ballast and spaced apart from each other so that a center of the topsides is laterally disposed between the barges;

installing one or more bracing members between the topsides and each barge with the ballast at a portion of the barges disposed inwardly toward the center of the topsides; and adjusting the ballast after installing the bracing members to create a lifting force from the barges through the bracing members to the topsides to reduce a sagging bending moment applied on the topsides that is caused by the weight of the topsides suspended between the float-over barges, the float-over barges supporting the topsides at least partially above a surface of water.

16. The method of claim 15, further comprising preinstalling the ballast to the barges at any time prior to installing the one or more bracing members.

17. The method of claim 15, wherein installing the one or more bracing members occurs before transferring the topsides is completed.

18. The method of claim 15, wherein adjusting the ballast comprises at least partially removing the ballast from the barges.

19. The method of claim 15, wherein adjusting the ballast comprises moving the ballast from one or more tanks on the barges disposed toward the center of the topsides to other tanks on the barges disposed away from the center of the topsides.

20. The method of claim 15, wherein further comprising disposing the ballast inwardly from a lateral center of gravity of the barges before transferring the topsides to the barges.

21. The method of claim 15, further comprising hingeably coupling the topsides with the barges.

22. A catamaran system created for an offshore structure, comprising:

a topsides having a weight and adapted to be transferred onto the offshore structure;

at least two float-over barges adapted to receive a transfer of the topsides onto the float-over barges and support the topsides at least partially above a surface of water during transportation to the offshore structure, the topsides being coupled to each of the barges with the barges being spaced apart from each other so that a center of the topsides is disposed between the barges, the barges comprising a ballast adapted to create a downward bias on a portion of the barges disposed toward the center of the topsides; and a bracing member coupled between the topsides and each barge at the portion, the bracing member being coupled when the portion is downwardly biased, the ballast further being adjustable to at least partially reduce the downward bias and create a lifting force on the topsides through the bracing member during the transportation to counteract a sagging bending moment applied on the topsides that is caused by the weight of the topsides suspended between the float-over barges.

23. The system of claim 22, wherein the ballast is disposed inwardly from a lateral center of gravity of the barges and toward the center of the topsides.

24. The system of claim 22, wherein the ballast comprises a removable ballast to at least partially reduce the downward bias.

25. The system of claim 22, wherein the ballast is adapted to be moved to another portion of the barges to at least partially reduce the downward bias.

26. The system of claim 22, further comprising another ballast disposed on another portion of the barges to at least partially reduce the downward bias.

27. The system of claim 22, wherein the topsides is hingeably coupled with the barges.

28. A catamaran system created for a fixed or floating offshore structure, comprising:

a topsides having a weight and adapted to be transferred onto the offshore structure;

at least two float-over barges adapted to receive a transfer of the topsides onto the float-over barges and support the topsides at least partially above a surface of water, the topsides being coupled to each of the barges with the barges being spaced apart from each other so that a center of the topsides is disposed between the barges;

a bracing member coupled between the topsides and each barge at a portion of the barges disposed inwardly toward the center of the topsides;

the barges each having a ballast, the ballast being adjustable after the bracing members are coupled to create an upward force on the bracing members to at least partially reduce a sagging bending moment applied on the topsides that is created by the weight of the topsides suspended between the float-over barges.

29. The system of claim 28, wherein at least a portion of a ballast is disposed outwardly from a lateral center of gravity of the barges in a direction distal from the topsides coupled between the barges, the ballast adapted to at least partially reduce the sagging bending moment.

30. The system of claim 28, wherein at least a portion of a ballast disposed inwardly from a lateral center of gravity of the barges in a direction proximal to the topsides coupled between the barges is removed or redistributed to a location outwardly from the lateral center of gravity of the barges, the at least portion of the ballast being adapted to at least partially reduce the sagging bending moment.

31. The system of claim 30, wherein the ballast condition comprises a ballast coupled to the barges to create a downward bias on a portion of the barges disposed inwardly toward the center of the topsides prior to the bracing members being coupled between the topsides and the barges, and wherein the ballast condition is adapted to be adjustable to create the upward force on the topsides after the bracing members are coupled between the topsides and the barges.

32. The system of claim 31, wherein the ballast condition that is adapted to be adjustable comprises a reduced ballast at the downwardly biased portion of the barges, an added ballast disposed outwardly from a lateral center of gravity of the barges, a redistributed ballast disposed at least partially outward from the lateral center of gravity, or a combination thereof to at least partially reduce the sagging bending moment.

33. The system of claim 28, wherein the catamaran system is adapted to transport the topsides to the offshore structure while the sagging bending moment is at least partially reduced by the ballast.

* * * * *